United States Patent [19]

Brochman

[11] 4,378,074

[45] Mar. 29, 1983

[54] EASY OPEN CLOSURE SYSTEM

[75] Inventor: Wilfred R. Brochman, Oakdale, Minn.

[73] Assignee: Minnesota Mining and Manufacturing Company, St. Paul, Minn.

[21] Appl. No.: 264,657

[22] Filed: May 18, 1981

[51] Int. Cl.[3] ..... B65D 41/02

[52] U.S. Cl. ..... 220/260; 220/258; 220/271; 220/359

[58] Field of Search ..... 220/258, 260, 270, 359, 220/271; 229/7 R; 222/541, 485

[56] References Cited

U.S. PATENT DOCUMENTS

| | | | |
|---|---|---|---|
| 201,939 | 4/1978 | Nolty . | |
| 3,186,581 | 6/1965 | Schneider et al. | 220/53 |
| 3,339,788 | 9/1967 | Lipske | 220/270 |
| 3,475,246 | 10/1969 | Collie | 156/268 |
| 3,610,462 | 10/1971 | Saunders | 220/54 |
| 3,847,300 | 11/1974 | Waters | 220/269 |
| 3,883,034 | 5/1975 | Rausing | 220/268 |
| 3,977,562 | 8/1976 | Wedzik | 220/270 |
| 3,990,603 | 11/1976 | Brochman | 220/260 |
| 4,054,228 | 10/1977 | Balocca et al. | 220/268 |
| 4,108,330 | 8/1978 | Patterson | 220/260 |
| 4,135,637 | 1/1979 | Hannula | 220/271 |
| 4,163,506 | 8/1979 | Patterson | 220/260 |
| 4,165,015 | 8/1979 | Hasegawa | 220/269 |
| 4,189,060 | 2/1980 | Trotman | 220/260 |

*Primary Examiner*—George T. Hall

*Attorney, Agent, or Firm*—Cruzan Alexander; Donald M. Sell; John C. Barnes

[57] ABSTRACT

An easy opening closure system comprising a container end portion having an opening and a scored portion adjoining the opening. An exterior tape and interior sheet material cover the opening and sandwich the scored portion. Removal of the exterior tape initiates tear of the scored portion and permits the scored portion to be pulled back away from the opening to enlarge the opening. A preferred easy opening closure system includes a reinforcing member which is adhered to the underside of the scored portion and to the exterior tape in the area of the opening. The reinforcing member facilitates bending of the scored portion away from the opening.

11 Claims, 7 Drawing Figures

EASY OPEN CLOSURE SYSTEM

BACKGROUND OF THE INVENTION

This invention relates to containers having easy open closure systems. The invention also relates to end portions useful for containers adapted to package carbonated beverages.

Two tape closure systems for containing beverages are well known in the art, e.g., see U.S. Pat. Nos. 3,990,603 (Brochman), 4,108,330 (Patterson) and 4,135,637 (Hannula). Similarly, one tape closure systems are also known in the art, e.g., see U.S. Pat. No. 4,165,015 (Hasegawa).

SUMMARY OF THE INVENTION

In accordance with the present invention there is provided an easy opening closure system comprising a container end portion having an opening and a scored portion adjacent said opening which can be pulled back away from said opening to enlarge said opening, said closure system further comprising:

(a) An exterior tape which is circumjacent said opening and is firmly adhered to said scored portion to provide means by which said scored portion can be pulled back away from said opening; and (b) an interior tape which covers the underside of said opening and which is firmly adhered to the bottom surface of the container end portion circumjacent said opening and to said exterior tape in the area of said opening.

A preferred easy opening closure system also comprises a reinforcing member (e.g., a tape) which facilitates the bending of the scored portion away from the opening.

The invention provides an improved commercially desirable closure for use with still beverages packed under atmospheric or subatmospheric pressures, low pressure non-carbonated beverages, and carbonated beverages.

DETAILED DESCRIPTION OF THE INVENTION

The invention is described in more detail hereinafter with reference to the accompanying drawings wherein like reference characters refer to the same parts throughout the several views and in which.

Figure 1:
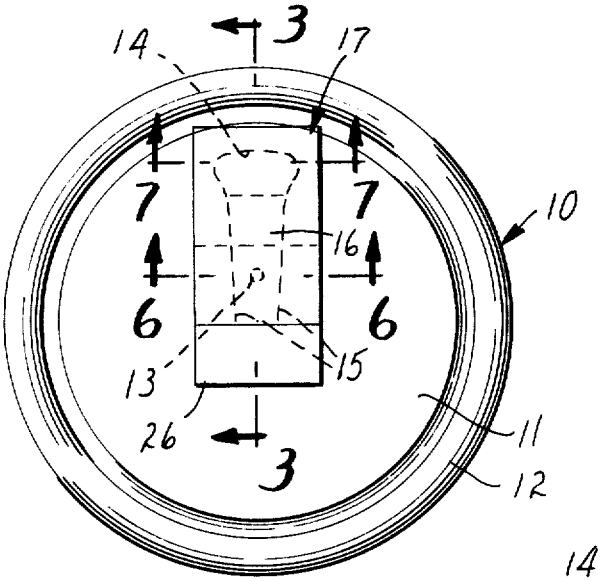
FIG. 1 is a top view of one embodiment of the present invention.
Figure 2:
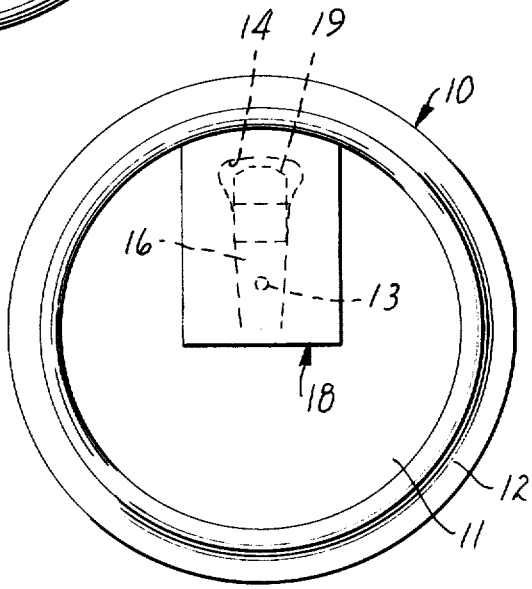
FIG. 2 is a bottom view of the embodiment of FIG. 1.
Figure 6:
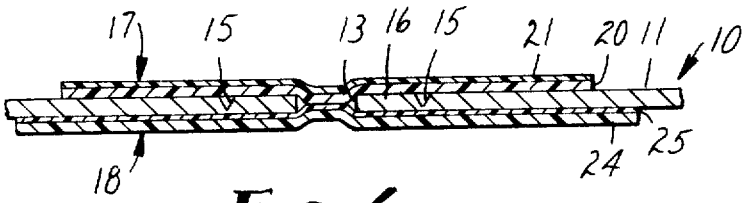
FIG. 6 is an enlarged section view taken along line 6—6 of FIG. 1 showing the closure system prior to venting or opening.
Figure 7:
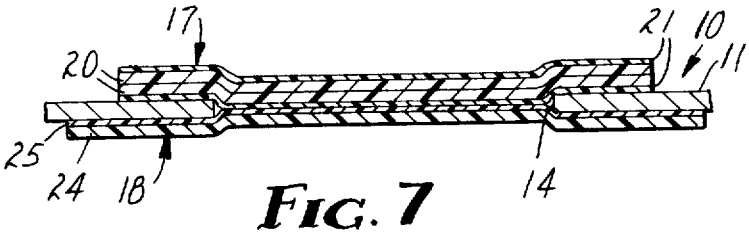
FIG. 7 is an enlarged section view taken along the line 7—7 of FIG. 1 showing the closure system prior to venting or opening.

Thus, in FIG. 1 there is shown a container end portion 10 (such as might be seamed onto a cylindrical, metal container body) comprising a generally circular, flat, rigid disc or lid 11 defined by edge 12, the end portion having therein a vent opening 13 (shown in phantom), a preformed opening 14 (shown in phantom), and a pair of score lines 15 (best illustrated in FIG. 6) extending from said preformed opening 14 towards the center of the container end portion 10. Preformed opening 14 and score lines 15 define a scored portion 16 adjoining said preformed opening 14. Such an end portion might be produced in large numbers as in a stamping and scoring operation. The rectangular exterior tape 17 is shown covering the preformed opening 14, vent hole 13, and scored portion 16. The interior sheet material 18 and reinforcing member 19 (here illustrated as a tape), which are attached to the underside of the container end portion, are illustrated in FIG. 2. Interior sheet material 18 covers the underside of the vent hole 13, preformed opening 14 and scored portion 16. The placement of reinforcing member 19 will be discussed in greater detail hereinbelow.

Figure 3:
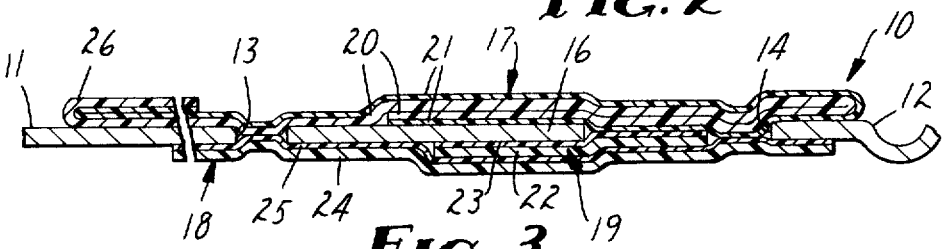
FIG. 3 is a section view taken along line 3—3 of FIG. 1 showing the closure system prior to venting or opening.

FIG. 3 illustrates the folding of the exterior tape 17 near the edge 12 of the end portion disc such that the portion of exterior tape which overlays the portion of the exterior tape circumjacent the vent hole 13. Exterior tape 17 comprises backing member 20 which is firmly adhered to the topside of the container end portion 10 circumjacent preformed opening 14 by means of adhesive layer 21. Reinforcing member 19 comprises a backing member 22 which is firmly adhered to the underside of the container end portion in the area of said scored portion 16 and to the exterior tape 17 in the area of preformed opening 14 by means of adhesive layer 23. While reinforcing member 19 extends underneath scored portion 16, reinforcing member 19 should not interfere with the functioning of vent hole 13. It is preferred that reinforcing member 19 not cover vent hole 13. Finally, interior sheet material 18 comprises backing member 24 which is firmly adhered to the underside of container end portion 10 circumjacent preformed opening 14, vent hole 13 and score lines 15 by means of adhesive layer 25. Interior sheet material 18 is also firmly adhered to exterior tape 17 in the area of vent hole 13 and to the backing member 22 of reinforcing member 19 by means of adhesive layer 25. Additionally, interior sheet material 18 is firmly adhered to exterior tape 17 in the area of preformed opening 14 by means of adhesive layer 21 of exterior tape 17 and adhesive layer 25 of interior sheet material 18. Also shown is grip portion 26 of the exterior tape 17.

Figure 4:
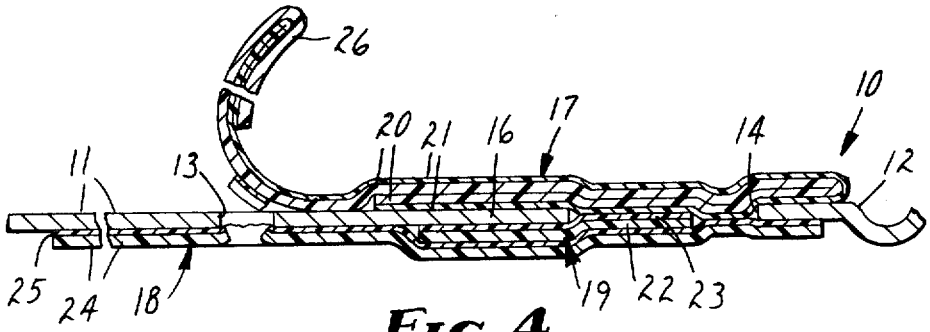
FIG. 4 is a section view similar to FIG. 3 after venting of the container has occurred, but before the container end pour hole has been opened.
Figure 5:
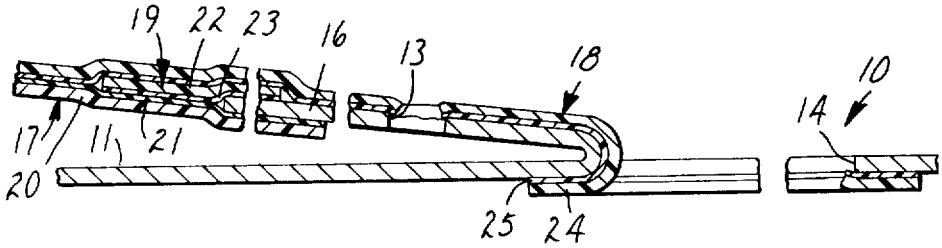
FIG. 5 is a section view similar to FIG. 3 after both venting and opening of the container end pour hole has occurred.

In FIG. 4 venting of the container has occurred. In FIG. 5, opening of the container has subsequently occurred. Scored portion 16, when pulled back from the opening, is effective in holding the removed exterior tape, reinforcing member and interior sheet material away from the pour hole.

The operation of the closure system depicted in FIGS. 1, 2, 3, 4 and 5 may be visualized by examination of the illustrations. The consumer encounters the top of a beverage container as depicted in FIG. 1. Placing a finger adjacent to the grip portion 26 of the exterior tape 17 and pulling in any direction away from the container end portion 10, vents the container to ambient pressure (as illustrated in FIG. 4). Continued application of a removing force to the grip portion 26 reverses the peel direction and begins to peel the exterior tape from adjacent edge 12 of the container end. Subsequently, interior material 18 is torn and removed in the area of preformed opening 14. Also, as the exterior tape 17 is removed from the container end portion 10, score lines 15 begin to rupture and scored portion 16 is subsequently pulled or bent back away from the preformed opening 14, thereby enlarging preformed opening 14. Complete opening of the container is depicted in FIG. 5, wherein exterior tape 17, reinforcing member 19 and a segment of interior sheet material 18 are shown folded away from preformed opening 14 which has now been enlarged. Scored portion 16 secures the closure system to the container end 10 and directs the fully opened closure system away from the preformed opening 14.

The preformed opening 14 may be of any shape and size so long as it provides for a level of bonding between reinforcing member 19 and exterior tape 17 (if reinforcing member 19 is employed) and between interior sheet material 18 and exterior tape 17 which permits bending or pulling back of the scored portion 16 away from the preformed opening 14 when exterior tape 17 is pulled away from container end portion 10. A preferred preformed opening has an area of about 0.075 to about 0.2 square inches. It is also preferred that the preformed opening be of a shape which facilitates tearing of the interior sheet material. The shape illustrated in the drawings has been found to be particularly suitable for preformed opening 14.

The depth and configuration of score lines 15 defining scored portion 16 will depend on the particular beverage which will be contained using the closure systems of the present invention. Those skilled in the art will be able to select suitable depths and configurations for score lines 15. It is also to be understood that the size and shape of scored portion 16 may be varied and still be within the scope of the present invention.

The backing member 20 of exterior tape 17 should be of sufficient internal strength to allow it to remove the interior sheet material in the area of the preformed opening 14 and to allow it to bend the scored portion 16 of the container end 10 back away from preformed opening 14. Thus the backing member 20 of exterior tape 17 should preferably be 25–250 micrometers in thickness and should neither break nor elongate more than 25% under a tension of 4 pounds (1.8 kg). At a width of ¾ inch (1.9 cm), the backing member should have a strength at break of at least 4 pounds (1.8 kg.) in order to withstand the forces exerted on it with an adequate margin of safety.

It is also preferred that backing member 20 be sufficiently flexible to permit it to conform to the preformed opening cavity. Conformability of the backing member to the pour hole cavity assures clean pull-out of the interior sheet material in the area of the pour hole.

Representative materials which have been found to be suitable for backing member 20 of exterior tape 17 include polypropylene, polytetramethylene terephthalate (e.g., that available under the trade designation "Valox 303" from General Electric Corporation), polyamide derived from 6—6 nylon (e.g., that available under the trade designation "Zytel ST 801HS" from E. I. duPont deNemours Co.), physical blends of polytetramethylene terephthalate/polyethylene, physical blends of polytetramethylene terephthalate/phenoxy, glycol modified polyethylene terephthalate (e.g. that available under the trade designation "Kodar 6763" from Eastman Chemical Products, Inc.), unplasticized polyvinylchloride, polyethylene terephthalate/polyethylene composites (e.g. that available under the trade designation of "Scotchpac" from 3M Co.), and films derived from a graft copolymer comprising acrylonitrile/methylmethacrylate copolymer grafted onto an acrylonitrile/butadiene copolymer backbone (e.g. that available under the trade designation "Barex" from Vistron Corporation). Other representative materials include thin metal foils such as dead-soft aluminum as well as metal foil-film composites. A preferred material is a polycarbonate film (e.g., that available under the trade designation "Merlon 700" from Mobay Corporation) of between 75 and 125 micrometers in thickness.

Those backing members which are plastic may be pigmented to produce opacity when such is desired. The pigment may be coated onto the backing member or may be added during the extrusion of the backing member itself.

The adhesive layer 21 of exterior tape 17 is preferably less than 250 micrometers in thickness and is firmly anchored to backing member 20.

In order to provide suitable results for packaging beverages under about 30 to 90 pounds per square inch, the adhesive should afford resistance to dead load shear of at least 17.6 p.s.i. (1.24 kg/cm$^2$) for at least 1000 minutes at 200° F. (93° C.). This shear strength is measured in the following manner: Test strips of the tape ½×6 inches (1.27 cm×15.2 cm) are applied to a panel of enameled tin-free steel (of the type commonly used for metal can ends) and heat sealed to said panel at between about 320° F. and 350° F. (160° C. and 177° C.) for 5 seconds under pressure of 40 p.s.i. (2.81 kg/cm$^2$) in a heated press. The composite is cut 0.5 inch (1.27 cm.) from the edge of the panel so that a contact area of 0.5×0.5 inch (1.27 cm.×1.27 cm.) is formed. A hook is attached to the free end of the tape strip and the panel is mounted vertically in a circulating air oven at 200° F. (93° C.) for 2 minutes to reach equilibrium temperature. A 2000 gram weight is attached to the free end in such a manner as to exert its full weight in a shear force in the same plane as the 0.5×0.5 inch (1.27 cm.×1.27 cm.) contact area. The 2000 gram weight on a 0.25 sq. in. (1.62 sq. cm.) sample exerts a force of 17.6 p.s.i. (1.24 kg/cm$^2$).

Furthermore, the adhesive should be of the type such that the exterior tape has a peel resistance from the end portion of a container within the range of about 4 to 12 pounds per inch width (0.7 to 2.1 kg per cm. width) at temperatures from at least 35° F. to 100° F. (2° to 38° C.).

Examples of specific adhesives which have been found to work are thermoplastic copolyester elastomers. These include segmented polyether esters which are high molecular weight condensation polymers derived from aromatic dicarboxylic acids, polyalkylene ether glycols, and short chain diols. The dicarboxylic acids may be, if desired, blends of acids such as terephthalic acid, isophthalic acid, etc. The polyalkylene ether glycol is a material such as polytetramethylene ether glycol (e.g. 2000 mol. wt.). An example of a short chain diol is 1,4-butanediol. A particularly useful adhesive of the foregoing type is "Dyvax PB5050" (which is commercially available from E. I. duPont de Nemours Company). In this adhesive the molar ratio of acid to glycol is 1:1, and the acid is a 70/30 blend (on a molar basis) of terephthalic acid and isophthalic acid. The glycol is an 80/20 blend (on a molar basis) of 1,4-butanediol and polytetramethylene ether glycol (1000 mol. wt.). Adhesives of this type are described in U.S. Pat. No. 3,651,014, incorporated herein by reference.

These thermoplastic copolyester elastomers may be modified, if desired, by the addition thereto of tackifying resins. Useful tackifying resins may be described as hydrogenated rosin esters and terpene/urethane types which are well known, and include commercially available resins such as "Foral 105" (from Hercules Chemical Co.). When used, the tackifying resins are typically present in an amount of about 20 to 40% by weight of the adhesive.

Other examples of specific adhesives suitable for use as adhesive layer 21 are thermoplastic polyurethane adhesives. Particularly useful adhesives of the foregoing type are "Texin 480F" (which is commercially available from Mobay Corporation) and "Estane 58277" (which is commercially available from B. F. Goodrich Company).

When the closure system of the present invention is employed to contain still beverages or beverages having low carbonation (e.g., exhibiting about 4 to 30 pounds per square inch), it may be desirable to employ a pressure-sensitive adhesive on the exterior tape since this would provide a closure system which could be opened more easily than if a thermoplastic adhesive were employed. Suitable pressure-sensitive adhesives for this application are described in U.S. Pat. No. 3,389,827 (Abere et al.), incorporated herein by reference. Particularly suitable pressure-sensitive tapes for use as exterior tape 17 are described in copending application U.S. Ser. No. 264833, filed of even date and commonly assigned, incorporated herein by reference.

It is not necessary to prime the preferred polycarbonate film. However, in order to assure that the adhesive layer is firmly anchored to particular backing members, it is sometimes desirable to use a primer. For example, when the backing member is a film of polyethyleneterephthalate or poly-1,4-butyleneterephthalate, and the adhesive comprises a thermoplastic copolyester elastomer, it is desirable to use a primer (generally 60 to 3000 Angstroms in thickness) in order to obtain very firm anchorage of the adhesive to the film.

Useful primers for use in combination with the thermoplastic adhesives described herein are described in U.S. Pat. No. 3,990,603 (Brochman), incorporated herein by reference, and include polycarbodiimide polymers, a polyurethane (comprising the reaction product of 11.4 parts polyester diol, eq. wt. 8,000 and 1.1 parts polymethylenepolyphenylisocyanate, eq. wt. 132), and phenoxy resin (comprising thermoplastic condensation product of bisphenol A and epichlorohydrin, molecular weight about 30,000 with no terminal epoxy groups, commercially available from Union Carbide under the trade designation "Phenoxy PKHH").

Useful primers for use in combination with the pressure-sensitive adhesives described herein are described in said U.S. Pat. No. 3,389,827. A preferred primer is the linear saturated soluble polyester which is available under the trade designation "Vitel PE 222" from B. F. Goodrich Co. This polyester comprises the following residues (amounts indicated on a molar basis): terephthalic acid (23%), isophthalic acid (21%), aliphatic diacids (7%), ethylene glycol (27%) and neopentyl glycol (21%).

In addition to priming the backing member, it is sometimes desirable to corona treat the backing member prior to application of the primer.

When a tape is employed as reinforcing member 19, it may generally comprise the same backing members and adhesives discussed above as being suitable for the exterior tape 17. A preferred backing for reinforcing tape 19 is above-mentioned "Merlon 700" and a preferred adhesive for that tape is above-mentioned "Textin 480F". Alternatively, a film may be employed as reinforcing member 19. Suitable materials for such a film include the same backing members discussed above as being suitable for the exterior tape 17.

The characteristics of the interior sheet material are critical to proper operation of the closure system of the invention. Functionally speaking, the interior sheet material must be capable of resisting rupture and tear propagation due to the gas pressure in a filled container while also permitting easy and complete removal thereof from the pour hole when the exterior tape is stripped away from the filled container. Thus, the interior sheet material must have properties of resisting tear and rupture when the container is filled and yet have properties which permit easy and clean tearing around the periphery of the pour hole when tear is initiated by removal of the exterior tape.

In order for the interior sheet material to perform in the desired manner when employed for packaging beverages under about 30 to 90 pounds per square inch, it has been found that the backing member 24 and adhesive 25 must have proper balance of several characteristics. Backing member 24 preferably has a thickness of about 15 to 50 micrometers and should have a PPT value in the range of about 15 to 200 grams/ply. The PPT value is a measure of the force required to initiate a tear and to propagate such tear, and it is measured according to ASTM D-2582-67 (Reapproved 1978). When the PPT value is below 15 grams/ply the backing member is generally too weak and fragile to withstand normal processing and handling in the manufacture of a film and in the fabrication of a closure. When the PPT value is greater than about 200 grams/ply the backing member is generally too tough and initiation of tear is extremely difficult. If it is desired to use backings having a PPT value in the neighborhood of 200 grams/ply, it may be desirable to perforate or score the backing member at a point adjacent the leading edge of the pour hole.

Also, the backing member 24 should have a break strength (in both machine and transverse directions) of between about 5 to 20 pounds per inch width (0.9 to 3.6 kg/cm width), and preferably 10 to 14 pounds per inch width (1.8 to 2.5 kg/cm width) and, in the event the backing member 24 is a plastic film, a break elongation of between about 80% to 200%, and preferably 90% to 130%. Break elongation and break strength are determined in accordance with the procedures of ASTM D-882 (Reapproved 1978).

The materials which have been found suitable as a backing member 24 for the interior sheet material include plastic film such as polycarbonate, physical blends of polycarbonate and a glycol modified polyethylene terephthalate (e.g., that available under the trade designation "Kodar A150" from Eastman Chemical Products, Inc.), polyethylene terephthalate, polyvinylchloride (unplasticized), composite films comprising a layer of polyethyleneterephthalate and a layer of a polyethyleneterephthalate/polyethyleneisophthalate copolymer (with respective monomer ratios ranging from 60/40 to 80/20 on a molar basis), films derived from a graft copolymer comprising acrylonitrile/methylacrylate copolymer grafted onto an acrylonitrile/butadiene copolymer backbone and dead soft aluminum foils. A particularly useful graft copolymer is formed by graft polymerizing acrylonitrile (73–77 parts by wt.) and methyl acrylate (23–27 parts by wt.) in the presence of 8 to 10 parts by wt. of an acrylonitrile/butadiene copolymer (70% by wt. derived from butadiene). The preferred material is a composite film comprising a layer of polyethyleneterephthalate and a layer of a polyethyleneterephthalate (80)/polyethylene isophthalate (20) copolymer, preferably prepared by coextrusion, as taught in U.S. Pat. No. 3,871,947, incorporated herein by reference.

For packaging beverages under between about 4 and 30 pounds per square inch, the break strength (in both machine and transverse directions) of the backing member 24 should be between about 5 to 12 pounds per inch width (0.9 to 2.1 kg/cm width) and preferably 7 to 10 pounds per inch width (1.25 to 1.8 kg/cm width).

The adhesive layer 25 is preferably less than about 100 microns in thickness and is firmly anchored to the backing member.

Adhesives which have been found suitable for use on the interior sheet material should afford resistance to "dead load shear" of at least 17.6 p.s.i. (1.24 kg/cm$^2$) for at least 1000 minutes at 200° F. (93° C.) if beverages packed under pressures of 30 to 90 pounds per square inch are being contained. Additionally the adhesive must have resistance to peel from the exterior tape in the area of the pour hole in excess of 12 pounds per inch width (2.1 kg. per cm. width) at temperatures from at least 35° F. to 100° F. (2° to 38° C.), and the adhesive must be firmly bonded to the underside of the container. Specific adhesives which are useful here include those which have been described above as being useful as the adhesive layer on the exterior tape. A preferred adhesive is the thermoplastic copolyester elastomer "Dyvax PB-722" (commercially available from E. I. duPont de Nemours Company). The adhesive polymer of this adhesive is similar to that of the above-mentioned "Dyvax PB 5050" except that here the polytetramethylene ether glycol is 2000 in molecular weight.

In one embodiment, the interior sheet material comprises a composite plastic film in which one layer thereof serves as the backing member and the other layer thereof serves as the adhesive. This particular composite film comprises a layer of polyethyleneterephthalate (which serves as the backing member) and a layer of polyethyleneterephthalate (50–90)-/polyethyleneisophthalate (10–50)/copolymer (which serves as a heat-sealable adhesive).

In the event that the beverage being contained by the closure system of the present invention is a still beverage or is only lightly carbonated and in the event that a pressure-sensitive adhesive is employed on the exterior tape, the protective tape disclosed in said copending application U.S. Ser. No. 264,833, may be employed as the interior sheet material of the present closure system. The protective tape disclosed therein is particularly useful in preventing essential oils such as d-limonene which may be contained in certain still or lightly carbonated beverages from attacking and dissolving the pressure-sensitive adhesive of the exterior tape.

Preferred container end portions comprise an enamel coating on the underside of each container end portion (and on the top side as well). During the scoring operation, it is possible that the enamel coating underneath the scored portion may have been abraded and bare metal may have been exposed thereby. In such situations, it may be desirable to have the interior sheet material cover the entire underside of the scored portion in order to avoid corrosion which may otherwise occur.

Employment of a reinforcing member 19 is preferred in the practice of the present invention in order to facilitate pulling or bending of the scored portion away from the preformed opening. In the event that reinforcing member 19 is not employed, it may be desirable to strengthen the bond between the exterior tape and the scored portion of the container end through employment, for example, of a phenolic-epoxy adhesive. A suitable adhesive of this type comprises (a) 60 parts by weight of a thermoplastic condensation product of bisphenol A and epichlorohydrin with a molecular weight of about 30,000 with no terminal epoxy groups ("Phenoxy PKHH", commercially available from Union Carbide), and (b) 40 parts by weight of a solid epoxy resin which is a condensation product of bisphenol A and epichlorohydrin ("Epon 1004," commercially available from Shell Chemical Co., softening point 95°–105° C., epoxide equivalent weight 875–1025).

Closure systems comprising two thermoplastic tapes are prepared as follows. Blank metal end portions for containers (e.g., cans), which have been coated with a thin layer of enamel coating by the can end manufacturer, are typically punched in order to provide a preformed opening and a vent opening and are thereafter typically scored by conventional methods to provide means by which the pour hole can be enlarged. Generally speaking, the pressure used to affix the exterior tape and interior sheet material to the can end is relatively uniform around the periphery of the pour hole and in the pour hole itself where the exterior tape is firmly bonded or secured to the interior sheet material. The pressures used are generally in the range of about 20 to 40 p.s.i. (1.4 to 2.8 kg/cm$^2$), and the temperatures used are generally in the range of about 300° to 350° F. (150° C. to 177° C.). The time required, at such pressures and temperatures, to effect good bonds of the exterior tape and interior sheet material to the can end is normally not more than a few seconds (e.g. 5–10 seconds). The entire bonding operation may be done, if desired, at one time using a heated press or the like.

Closure systems comprising a pressure-sensitive exterior tape and the protective tape disclosed in said copending application U.S. Ser. No. 264,833 are preferably fabricated using the bonding method which is disclosed in copending application U.S. Ser. No. 264,832 filed of even date and commonly assigned, incorporated herein by reference.

The devices disclosed in said copending application U.S. Ser. No. 264,832 may also be employed in bonding the closure systems comprising two thermoplastic adhesive tapes.

Other variants of this invention will be apparent to those skilled in the art.

I claim:

1. An easy opening closure system comprising a container end portion having an opening therein and a pair of score lines in said end portion extending from said opening toward the center of said end portion to define a scored portion adjoining said opening which can be pulled back away from said opening to enlarge said opening, said closure system further comprising:

(a) an exterior tape which is circumjacent said opening and is firmly adhered to said scored portion; and (b) an interior sheet material which covers the underside of said opening and which is firmly adhered to the bottom surface of said container end portion circumjacent said opening and to said exterior tape in the area of said opening to sandwich said scored portion between said tape and sheet material for initiating the tear of said scored portion from said end portion and provide therewith means to pull said scored portion back from said opening.

2. An easy opening closure system comprising a container end portion having an opening therein and a scored portion adjoining said opening which can be pulled back away from said opening to enlarge said opening, said closure system further comprising:

(a) an exterior tape which is circumjacent said opening and is firmly adhered to said scored portion to provide means by which said scored portion can be pulled back away from said opening;

(b) a reinforcing member which is firmly adhered to the exterior tape in the area of said opening and which extends underneath said scored portion; and (c) an interior sheet material which covers the underside of said opening and said reinforcing member and which is firmly adhered to the bottom surface of said container end portion circumjacent said opening, to said reinforcing member, and to said exterior tape in the area of said opening.

3. An easy opening closure system comprising a container end portion having a preformed opening therein, a scored portion adjoining said preformed opening which can be pulled back away from said preformed opening to enlarge said preformed opening and a vent hole within said scored portion, said closure system further comprising:

(a) an exterior tape which is circumjacent said preformed opening and said vent hole and which is firmly adhered to said scored portion to provide means by which said scored portion can be pulled back away from said preformed opening;

(b) a reinforcing member which is firmly adhered to said exterior tape in the area of said preformed opening and which extends underneath said scored portion; and (c) an interior sheet material which covers the underside of said preformed opening, said vent hole and said reinforcing member and which is firmly adhered to the bottom surface of said container end portion circumjacent said preformed opening and said vent hole, to said reinforcing member, and to said exterior tape in the area of said preformed opening and said vent hole.

4. An easy opening closure system in accordance with claim 3, wherein said reinforcing member is a film.

5. An easy opening closure system in accordance with claim 3, wherein said reinforcing member is a tape which is also adhered to the underside of said scored portion.

6. An easy opening closure system in accordance with claim 3, wherein said exterior tape comprises a backing selected from the group consisting of polypropylene, polytetramethylene terephthalate, polycarbonate, polyamide derived from 6—6 Nylon, physical blends of polytetramethylene terephthalate/polyethylene, physical blends of polytetramethylene terephthalate/phenoxy, glycol modified polyethylene terephthalate, unplasticized polyvinylchloride, polyethylene terephthalate/polyethylene composites, films derived from a graft copolymer comprising acrylonitrile/methylmethacrylate copolymer grafted onto an acrylonitrile/butadiene copolymer backbone, thin metal foils, and metal foil-film composites.

7. An easy opening closure system in accordance with claim 3, wherein said exterior tape comprises an adhesive comprising a thermoplastic copolyester elastomer.

8. An easy opening closure system in accordance with claim 3, wherein said exterior tape comprises an adhesive which is a pressure-sensitive adhesive.

9. An easy opening closure system in accordance with claim 3, wherein said interior sheet material comprises a backing selected from the group consisting of polyethylene terephthalate, unplastized polyvinylchloride, composites comprising a layer of polyethylene terephthalate and a layer of polyethylene terephthalate/polyethylene isophthalate copolymer, a graft copolymer comprising acrylonitrile/methacrylate copolymer grafted onto an acrylonitrile/butadiene copolymer backbone, polycarbonate, physical blends of polycarbonate and a glycol modified polyethylene terephthalate, and dead soft aluminum foils.

10. An easy opening closure system in accordance with claim 3, wherein said interior sheet material comprises an adhesive comprising a thermoplastic copolymer elastomer.

11. An easy opening closure system in accordance with claim 3, wherein said closure system is adapted to withstand internal pressures in the range of about 30 to 90 pounds per square inch.

* * * * *